US006712442B1

(12) United States Patent
Pickett

(10) Patent No.: US 6,712,442 B1
(45) Date of Patent: Mar. 30, 2004

(54) METHOD OF IMAGE RASTERIZATION AND IMAGING AN ADDRESS SPACE AN INK JET PRINTERS

(75) Inventor: Peter Brown Pickett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 9 days.

(21) Appl. No.: 10/252,083

(22) Filed: Sep. 23, 2002

(51) Int. Cl.[7] ..... B41J 2/205; B41B 15/00
(52) U.S. Cl. ..... 347/15; 347/19; 358/1.9
(58) Field of Search ..... 347/15, 14, 19, 347/103; 358/1.2, 1.9, 1.12

(56) References Cited

U.S. PATENT DOCUMENTS

| | | | | |
|---|---|---|---|---|
| 4,272,771 | A | 6/1981 | Furukawa | |
| 5,059,984 | A | 10/1991 | Moore et al. | |
| 5,300,957 | A | 4/1994 | Burke | |
| 5,488,396 | A | 1/1996 | Burke et al. | |
| 5,625,390 | A | 4/1997 | Burke et al. | |
| 5,633,663 | A | 5/1997 | Matsubara et al. | |
| 5,675,365 | A | * 10/1997 | Becerra et al. | 347/9 |
| 5,734,393 | A | 3/1998 | Eriksen | |
| 5,748,328 | A | 5/1998 | Usami et al. | |
| 5,774,144 | A | 6/1998 | Eriksen | |
| 5,793,397 | A | * 8/1998 | Barker et al. | 347/88 |
| 5,828,396 | A | 10/1998 | Seto et al. | |
| 5,831,642 | A | 11/1998 | Matsubara et al. | |
| 5,841,451 | A | 11/1998 | Hirabayashi et al. | |
| 5,844,585 | A | 12/1998 | Kurashima et al. | |
| 5,949,452 | A | 9/1999 | Jones | |
| 5,988,790 | A | 11/1999 | Koike et al. | |
| 6,059,397 | A | 5/2000 | Jones | |
| 6,079,815 | A | 6/2000 | Cook et al. | |
| 6,109,746 | A | 8/2000 | Jeanmaire et al. | |
| 6,123,417 | A | 9/2000 | Bard et al. | |
| 6,130,685 | A | 10/2000 | Matsubara et al. | |
| 6,154,238 | A | 11/2000 | Cook et al. | |
| 6,161,921 | A | 12/2000 | Bard et al. | |
| 6,164,745 | A | 12/2000 | Nagoshi et al. | |

* cited by examiner

*Primary Examiner*—Lamson Nguyen
(74) *Attorney, Agent, or Firm*—Taylor & Aust, P.C.

(57) ABSTRACT

In a method of operating an inkjet printer, an intermediate transfer member is movable in an advance direction. A carrier supports a printhead, and is movable relative to the intermediate transfer member in a direction generally perpendicular to the advance direction. The printhead defines a plurality of raster lines extending over the intermediate transfer member at a non-perpendicular, fixed angle vector relative to the advanced direction. A bitmap image is defined which corresponds to an image to be formed on the intermediate transfer member. The bitmap image includes a plurality of rows and columns of pixels, with at least one image data corresponding to each pixel. The bitmap image is skewed such that the image data for at least one column within the bitmap image is shifted a predetermined number of pixel locations, dependent upon the fixed angle vector.

16 Claims, 4 Drawing Sheets

METHOD OF IMAGE RASTERIZATION AND IMAGING AN ADDRESS SPACE AN INK JET PRINTERS

BACKGROUND OF THE INVENTION

1. Field of the Invention

The present invention relates to ink jet printers, and, more particularly, to a method of rasterizing image data printed on an address space associated with an intermediate transfer member.

2. Description of the Related Art

Ink jet printers typically use one or more monochrome or color printheads to produce a printed document. In typical inkjet printers, the carrier moves horizontally across the print medium and the print medium is indexed in an, advance direction independently between scans of the carrier. This motion allows typical inkjet printers to print using an orthogonal, rectilinear address space. That is, all addressable pixels are located on a rectangular grid with an orthogonal axis. Inkjet printers print on the print medium using a desired ink dot density, such as a 600×600 dots per inch (dpi) grid. This process produces a printed document of high quality; however, often the time associated with printing is undesirably long. Non-printing time occurs during which the printheads are mechanically moved without jetting ink. This waste of mechanical energy in turn leads to unnecessary delays before an image is placed on the print medium and delivered to the user.

In order to minimize the non-printing time in an ink jet printer, it is known to use an intermediate transfer member (ITM), wherein an image is printed onto a repeating surface, such as a cylinder, and transferred to a print medium in a subsequent operation. The use an ITM to print upon minimizes the time and mechanical energy wasted during non-printing operations and provides a known, controlled and repeatable surface upon which to form the image. During the printing operation, the ITM rotates at a fixed speed. At the same time, the carrier moves from one end of the ITM to the other end at a constant linear speed as to follow a helical path on the ITM. The entire imaging operation is performed with no stops or starts with either the carrier system or the ITM system, thus minimizing energy waste. Therefore, it is no longer possible to produce or use an orthogonal, square, rectangular address space with the printheads during printing.

A continuous ITM as described above is also used with laser printers. A laser beam typically is reflected from a rotating polygon mirror and traversed across a photoconductive ITM as the polygon rotates. This occurs very fast and thus the helical effect associated with each line of pixels is negligible.

Ink jetting printers may also include an ink jet cartridge having a printhead with multiple or redundant major columns of ink jetting orifices. Each major column typically consists of multiple, staggered columns of ink jetting orifices, with the major columns being spaced apart from and parallel to each other. By providing redundant major columns of ink jetting orifices, each including multiple staggered columns of ink jetting orifices, print artifacts caused by clogged nozzles, faulty circuitry or the like may be avoided.

What is needed in the art is a method of printing with an inkjet printer using a continuous ITM, wherein the helical effect associated with printing on the ITM is minimized.

SUMMARY OF THE INVENTION

The present invention provides a method of operating an ink jet printer wherein the image data is skewed to offset the helical effect caused by printing on an intermediate transfer member.

The invention comprises, in one form thereof, a method of operating an inkjet printer. An intermediate transfer member is movable in an advance direction. A carrier supports a printhead, and is movable relative to the intermediate transfer member in a direction generally perpendicular to the advance direction. The printhead defines a plurality of raster lines extending over the intermediate transfer member at a non-perpendicular, fixed angle vector relative to the advance direction. A bitmap image is defined which corresponds to an image to be formed on the intermediate transfer member. A bitmap image includes a plurality of rows and columns of pixels, with at least one image data corresponding to each pixel. The bitmap image is skewed such that the image data for at least one column within the bitmap image is shifted a predetermined number of pixel locations, dependent upon the fixed angle vector.

The invention comprises, in another form thereof, a method of operating an ink jet printer. An intermediate transfer member is movable in an advance direction. A carrier supports a printhead, and is movable relative to the intermediate transfer member in a direction generally perpendicular to the advance direction. The printhead defines a plurality of raster lines extending over the intermediate transfer member at a non-perpendicular, fixed angle vector relative to the advance direction. A bitmap image is defined which includes an array of pixels. The bitmap image includes image data corresponding to each pixel. The bitmap image is skewed such that the image data for a selected pixel location is shifted to a different pixel location, dependent upon the fixed angle vector.

An advantage of the present invention is that the helical affect associated with printing on the continuous ITM is minimized.

Another advantage is that skewing of the image data to offset the helical affect may be selectively carried out depending on the quantitative value of the fixed angle vector.

Yet another advantage is that the spacing of the address space on the ITM and print medium may be varied by proportionally adjusting the linear carrier speed and rotational ITM speed.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
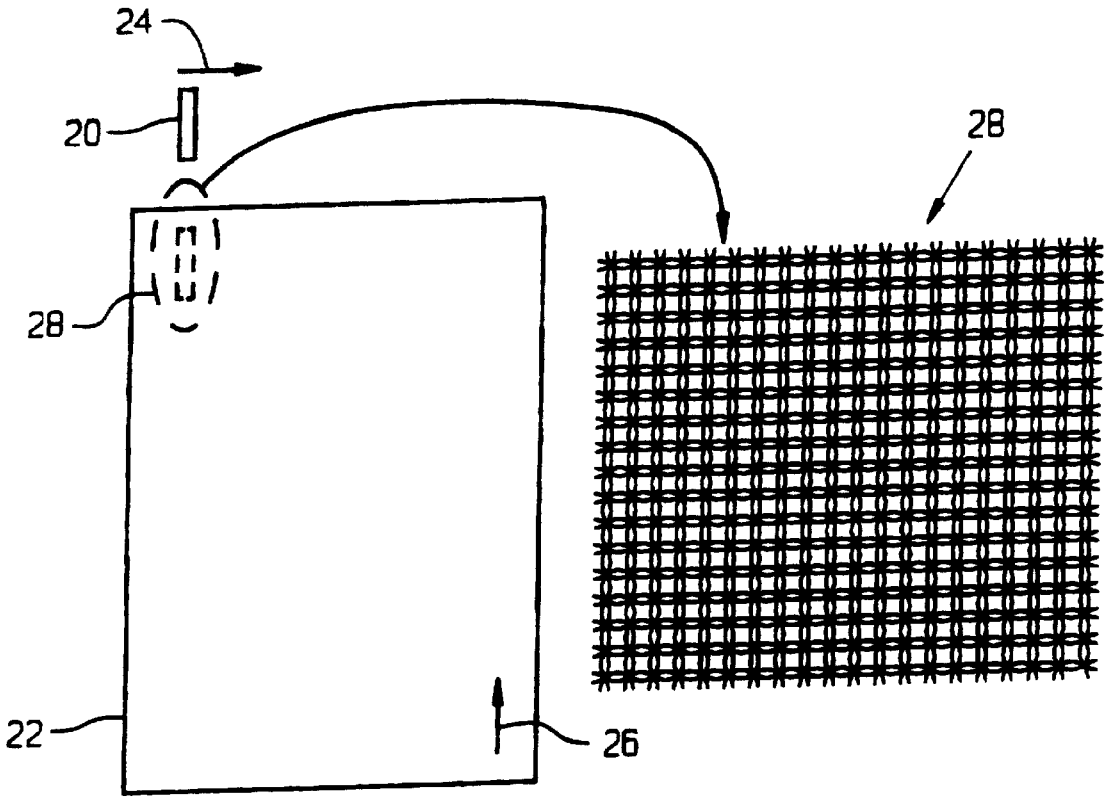
PRIOR ART Fig. 1
FIG. 1 is a graphical illustration of a conventional method of printing with an inkjet printer.

Referring now to the drawings, and more particularly to FIG. 1, there is shown a graphical illustration of a typical address space using an ink jet printer. A carrier 20 typically carries an ink jet cartridge (not specifically shown for simplicity sake) with one or more inks therein to be jetted onto print medium 22, such as paper. Each color ink carried buy carrier 20 is associated with a respective print head (not shown) with a plurality of ink jetting orifices form therein. Carrier 20 is movable in a perpendicular direction 24 across print medium 22, with respect to an advance direction 26 of print medium 22. Each ink dot is placed at an addressable location (i.e., pixel) on print medium 22, with the addressable locations defining an address space for placing the ink dots on print medium 22. A portion of the address space on print medium 22 is designated with the reference number 28. The address space 28 using a typical ink jet printer is an orthogonal, rectilinear address space. That is, all addressable pixels are located on a rectangular grid with an orthogonal axis. Carrier 20 moves across print medium 22 in scan direction 24 to place ink dots at selected pixel locations within address space 28. Print medium 22 is then advanced in advance direction 26 and carrier 20 is again scanned across print medium 22 to place ink dots at selected pixel locations.

Although it will be appreciated that the address space consists of circles corresponding to the ink dots placed on print medium 22, it should also be understood that a bitmap image is formed in the ink jet printer using suitable electrical processing circuitry, such as a microprocessor, memory, etc. The bitmap image consists of an array of square or rectangular cells arranged in an orthogonal; rectilinear manner. Image data for one or more colors of ink is associated with each cell or pixel in the bitmap image corresponding to ink drops which are to be placed on the address space overlying print medium 22.

In the embodiment shown in FIG. 1, address space 28 is an orthogonal, rectilinear address space with a dot spacing of 600×600 dpi. Printhead 20 is assumed to traverse across the width of print medium 22 at a traveling speed of 26.66 inches per second. Each ink jetting orifice or nozzle of printhead 20 (not shown) is assumed to be capable of firing a single drop of ink every 125 microseconds (8,000 hertz rate), providing the orthogonal, square, rectilinear 600×600 dpi address space shown in FIG. 1. Each drop, represented by an open circle, is placed on a rectangular grid location at a spacing of about 42.33 micrometers (600×600 dpi) from the nearest drop in all directions. This is quite convenient since the majority of digital image formats are an orthogonal, square, rectilinear arrangement of pixels. Since the digital image defined by the bitmap image in the electronic circuitry of the printer matches pixels for spots, this makes for easy rasterization of images for printing.

Figure 2:
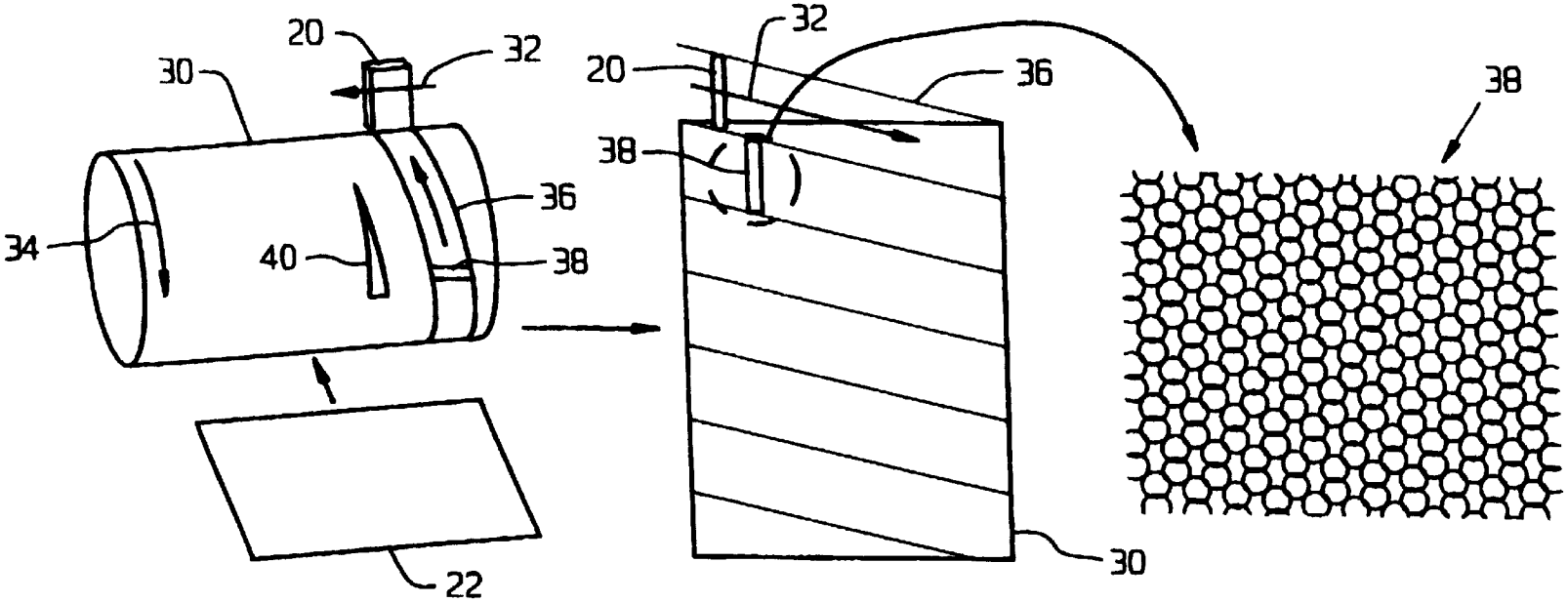
FIG. 2 is a graphical illustration of a method of printing with an inkjet printer using an intermediate transfer member.

Referring now to FIG. 2, there is shown an embodiment of a method of printing using a carrier 20 which is positioned in association with an ITM 30. In the embodiment shown, ITM 30 is assumed to be a cylinder which rotates during printing; however, ITM 30 may also be in the form of a belt, etc. ITM 30 transfers an image formed thereon to print medium 22.

Carrier 20 typically carries an inkjet cartridge having a printhead with a plurality of ink jetting orifices, and is positioned in association with ITM 30 such that ink dots may be placed on ITM 30 at selected pixel locations. Carrier 20 moves in a longitudinal direction across ITM 30 as indicated by arrow 32, and ITM 30 is assumed to rotate at a selected rotational speed as indicated by arrow 34. As carrier 20 translates and ITM 30 rotates, ink dots are placed on ITM 30 at selected pixel locations within a band 36 which helical around ITM 30. For illustration purposes, a selected portion of an address space 38 within band 36 will be discussed in greater detail.

To the right of the cylindrical representation of ITM 30, if the periphery of the cylinder was "unrolled", is a two-dimensional representation consisting of a plurality of adjacent bands 36 positioned relative to each other at the same angular orientation at which carrier 20 helical around cylindrical ITM 30. The ink dots placed within address space 38 therefore are not orthogonal and rectilinear with respect to each other. Carrier 20 (and the printhead carried thereby) no longer traverses along an orthogonal direction with respect to the media at a rate of 26.66 inches per second, but rather traverses along a fixed 6° angle vector at a rate of 26.66 inches per second. The possible ink dot placement locations within the illustrated portion of address space 38 therefore likewise extend at a 6° angle vector relative to each other as may be readily observed in the enlarged portion of address space 38 on the right of FIG. 2.

Also for explanation purposes, an approximate triangle 40 is shown overlying ITM 30. Triangle 40 has a hypotenuse positioned generally parallel to an edge of band 36, with the other two legs of the right triangle extending parallel and perpendicular to the axis of rotation of ITM 30, respectively. Triangle 40 is shown in more detail in FIG. 3. The angle $\theta$, corresponding to the helical or fixed angle vector of carrier 20 on ITM 30, is assumed to be 6° as indicated above. Moreover, the hypotenuse represented by the letter C is assumed to be 26.66 inches per second as indicated above. Therefore, the rotational surface speed of ITM 30 is 26.52 inches per second and carrier 20 travels in a scan direction across ITM 30 at a speed of 2.5 inches per second. Expressed as a ratio, this is approximately a 1:10 ratio, expressed as rise over run. By varying the rotational speed of ITM 30 and the translational speed of carrier 20, the actual scan speed of carrier 20 along band 36 may be selected with a different value.

As evident from the portion of address space 38 shown on the right of FIG. 2, each drop of ink from the printhead carried by carrier 20 is represented by an approximate circle. In the embodiment shown, each circle is assumed to be represented by an open 65 $\mu$m diameter circle, with the resulting address space being neither orthogonal nor rectilinear. There are spaces on ITM 30 (and in turn print medium 22) that are not addressable with this address space. There is also 100 percent dot overlap with this address space such that there exists wasted ink at locations where an ink drop is placed where a printed ink drop has already been placed.

Figure 4:
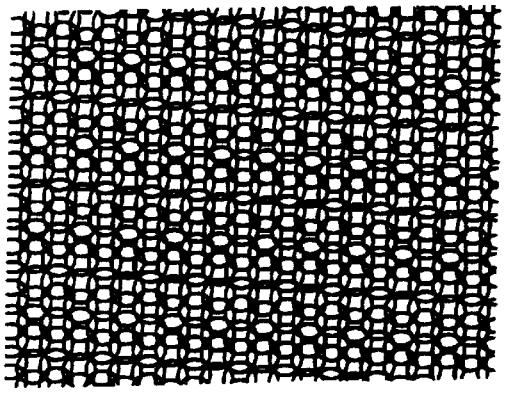
FIG. 4 illustrates a modified address space associated with an intermediate transfer member.

Utilizing the ability to adjust timing between adjacent columns of ink jetting orifices in the printhead, the address space 38 described above with reference to FIG. 2 can be modified. By delaying one side of the printhead timing by 62.5 microseconds (42.33 $\mu$m at 26.66 inches per second), the overlapping drops can be moved, resulting in the address space shown in FIG. 4. This address space is uniform and rectilinear, but not orthogonal. The address space shown in FIG. 4 provides 100% addressability of all points on ITM 30 and print medium 22. The address space shown in FIG. 4 is described herein as a skewed, rectilinear address space.

The printhead carried by carrier 20 has certain physical characteristics, such as a maximum firing frequency, thermal response times, etc. These physical characteristics and limitations may be associated with the electronics, heaters, ink flow channel geometries, ink, etc. The present invention optionally selectively adjusts the trajectory speed of carrier 20, without adjusting the firing rate (e.g., 8,000 hertz) or the nozzle firing order, to provide a different address space without increasing the stress level, either thermally or electrically, upon the printhead electronics or power supply. When adjusting the trajectory speed of carrier 20, the drive system for ITM 30 is adjusted by a relative amount such that the carrier 20 traverses over ITM 30 at the same fixed angle vector as before (e.g., 6°).

Figure 3:
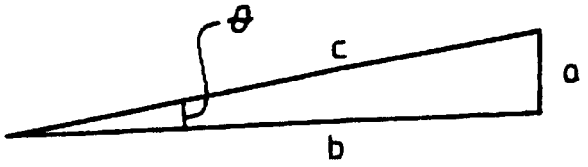
FIG. 3 is a graphical illustration of the geometric relationship associated with the helical effect of printing on an intermediate transfer member.
Figure 5:
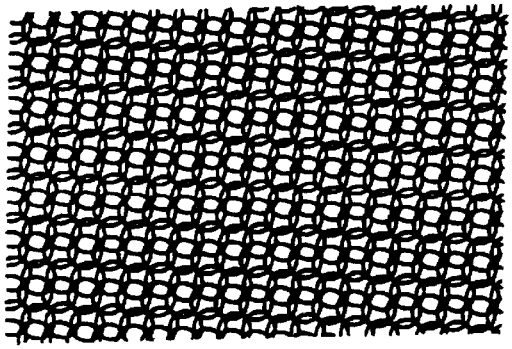
FIG. 5 illustrates another modified address space associated with an intermediate transfer member.

Referring to FIG. 5, the trajectory speed of carrier 20 is increased to 29.75 inches per second (in the direction of hypotenuse C in FIG. 3). This is a 12% increase in the trajectory speed, as compared to the previous trajectory speed of 26.66 inches per second. The resulting address space shown in FIG. 5 is uniform, but not rectilinear or orthogonal. The address space does provide 100% coverage; therefore, all points on print medium 22 can be addressed using this address space. The address space shown in FIG. 5 is very similar to the original skewed, rectilinear address space shown in FIG. 4, yet provides for a 12% increase in printing speed with only a small loss in perceived image quality or image information.

Figure 6:
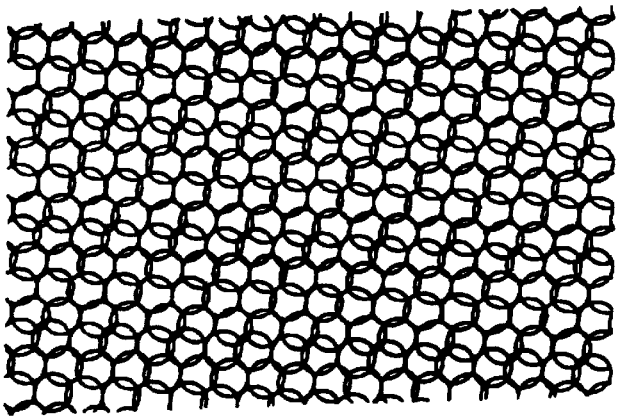
FIG. 6 illustrates yet another modified address space associated with an intermediate transfer member.

FIG. 6 illustrates an address space wherein the trajectory speed of carriage 20 is increased to 34.0 inches per second, a 28% increase over the original trajectory speed of 26.66 inches per second. The address space shown in FIG. 6 is uniform, but not rectilinear or orthogonal. The resulting address space provides near 100% coverage; therefore, all points on the print media 22 can be addressed. This address space provides near 100% coverage since the printed spots take on an approximate hexagonal packing structure. The address space shown in FIG. 6 can be described as a rotated, pseudo-hexilinear address space.

The trajectory speed of carrier 20 can be further increased to alter the address space on ITM 30 and print medium 22. For example, the trajectory speed of carrier 20 can be increased to 39.0 inches per second (a 46% increase) or 53.33 inches per second (a 100% increase). At this latter trajectory speed of carrier 20, the resulting address space no longer provides 100% addressability or coverage on ITM 30 or print medium 22. This address space can be used in a draft printing mode, and is referred to herein as a draft skewed rectilinear address space.

As is apparent from each of the address spaces illustrated and described above in FIGS. 2 and 4–6, the ink dots are placed at a fixed angle vector relative to each other, regardless of the selected trajectory speed of carrier 20. This in turn means that the image formed on print medium 22 is slanted at the same fixed angle vector. In other words, the resulting address space does not match pixel for pixel with typical computer raster formats. The present invention also skews the input bitmap image to reduce the effect of the slanted fixed angle vector caused by printing with ITM 30.

Figure 7:
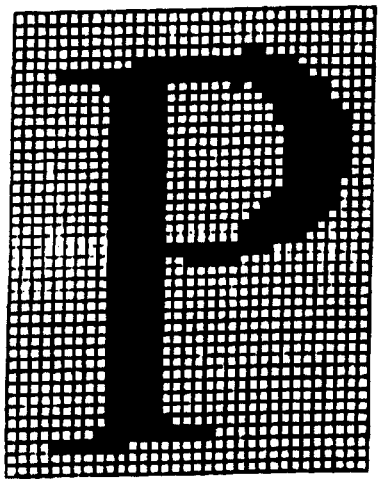
FIG. 7 illustrates rasterized image data after skewing to offset the helical effect associated with an intermediate transfer member.
Figure 8:
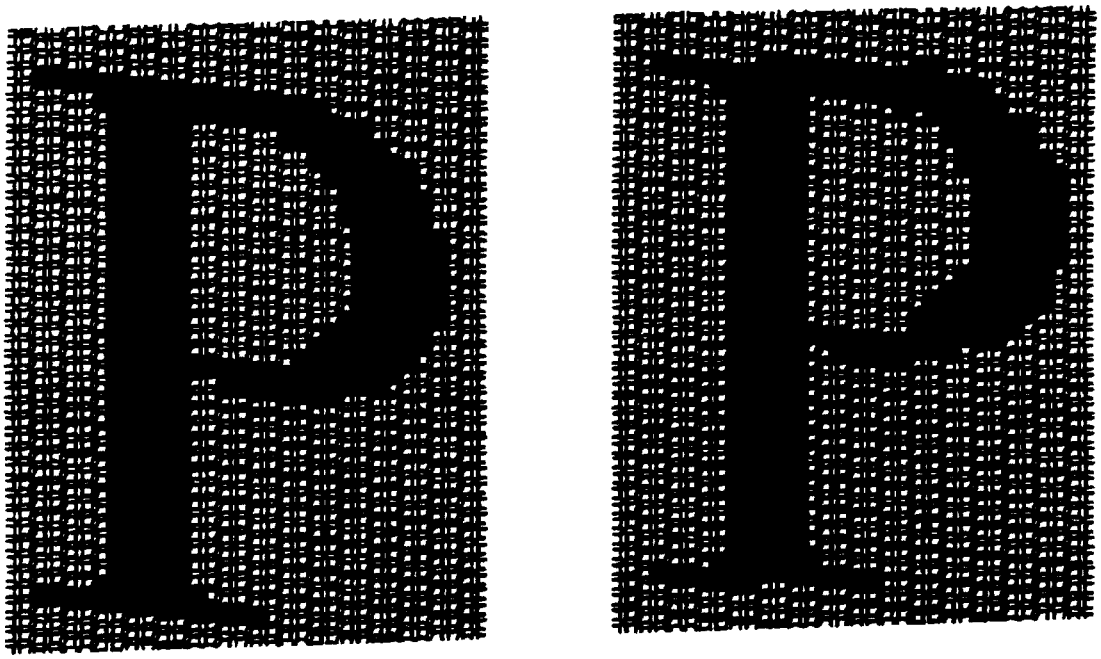
FIG. 8 illustrates a printed image in an address space on an intermediate transfer member after being skewed as shown in FIG. 7.

More particularly, referring to FIG. 7, an input bitmap image formed in the electrical processing circuitry of the ink jet printer is illustrated. The input bitmap image is skewed by an angle equivalent to the helical or fixed angle vector associated angle vector may also be expressed as a ratio of 1:10. Using this ratio of the fixed angle vector, the input bitmap image is "pre-skewed" before it is mapped to the final address space. In the example of FIG. 8, the original image is shifted up one pixel for every 10 pixels (or at another appropriate rate depending upon the fixed angle vector). In other words, one or more of the columns are skewed 1 pixel for every 10 pixels in the cross direction. This working image is still fundamentally a square rectilinear grid. Therefore, it still lends itself to typical computer stored structures and manipulations.

With respect to the cylindrical ITM 30 shown in FIG. 2, the skewing of the bitmap image as described above with reference to FIG. 7 occurs in a direction which is opposite to the direction of rotation 34 of ITM 30. By skewing the bitmap image in a direction opposite to the direction of rotation of ITM 30, the net effect is that the fixed angle vector associated with the address space is compensated to provide an improved print quality.

FIG. 8 illustrates placement of ink dots on the address space of ITM 30 and print medium 22 after the skewing operation is carried out as described above with reference to FIG. 7. In the embodiment shown, the letter "P" is printed on the address space. Normally, as show in the left hand block, the top of the letter "P" would continue in a downwardly angled direction corresponding to the fixed angle vector associated with printing the address space on the rotating ITM 30. However, as is apparent in the right hand block, the printed pixel locations within each column in the array of pixel locations are shifted upwardly at a proportionate ratio to the fixed angle vector. In this example, the pixel locations within each column are shifted upwardly a distance of 1 pixel for every 10 pixels in a lateral direction. Keeping in mind that the actual ink dot is approximately 1/600 inch, this provides an improved print quality to the printed image.

Figure 9:
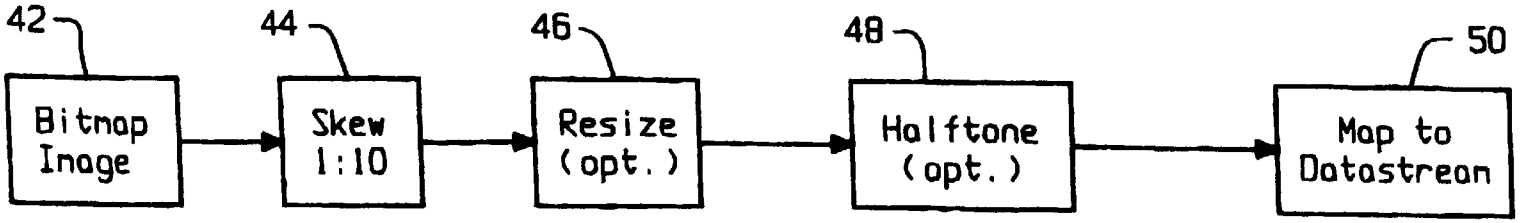
FIG. 9 is a flow chart of an embodiment of a method of operating an inkjet printer of the present invention.

FIG. 9 illustrates a flow chart for the inventive method of operating an inkjet printer as described above. At block 42, the image data is mapped to a bitmap image within electrical processing circuitry in the ink jet printer. This generally consists of an array of square or rectangular pixels, with one or more image data associated with each pixel. For example, the printer may be a monochrome or a color printer, in which case one or more inks would typically be used to print the image, respectively. At block 44, the bitmap image is skewed corresponding to the fixed angle vector associated with placing the image on rotating ITM 30. This is carried out by skewing the pixel locations at a ratio corresponding to the fixed angle vector in a direction opposite to the direction of rotation of ITM 30, as described above with reference to FIG. 7. The image may be optionally resized by proportionally adjusting the scan speed of carrier 20 and the rotational speed of ITM 30, as described above with reference to FIGS. 4–6 (block 46). At block 48, the digital image may be optionally manipulated using a halftoning technique, as is known. For reference to halftoning techniques in general, reference is hereby made to U.S. Pat. Nos. 6,363, 172; 6,356,363; and 6,307,647, which are owned by the assignee of the present invention and incorporated herein by reference. At block 50, the image data is mapped to the data stream used to fire the ink jetting heaters within the printhead carried by carrier 20.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of operating an inkjet printer, comprising the steps of:

providing an intermediate transfer member movable in an advance direction;

providing a carrier supporting a printhead, said carrier being movable relative to said intermediate transfer member in a direction generally perpendicular to said advance direction, said printhead defining a plurality of raster lines extending over said intermediate transfer member at a non-perpendicular, fixed angle vector relative to said advance direction;

defining a bitmap image corresponding to an image to be formed on said intermediate transfer member, said bitmap image including a plurality of rows and columns of pixels, said bitmap image including at least one image data corresponding to each said pixel; and skewing said bitmap image such that said image data for at least one column within said bitmap image is shifted a predetermined number of pixel locations, dependent upon said fixed angle vector.

2. The method of operating an inkjet printer of claim 1, wherein said skewing step includes shifting said image data for at least one column within said bitmap image a predetermined number of pixel locations in a direction opposite to said advance direction.

3. The method of operating an inkjet printer of claim 1, wherein said skewing step includes shifting said image data for at least one row within said bitmap image in a direction perpendicular to said at least one row to define an offset fixed angle vector generally corresponding to said fixed angle vector.

4. The method of operating an inkjet printer of claim 1, wherein said skewing step includes shifting image data for at least one column within said bitmap image an integer number of pixel locations in a direction opposite to said advance direction.

5. The method of operating an inkjet printer of claim 1, wherein said intermediate transfer member is movable in said advance direction at a first speed, and said carrier is movable in said perpendicular direction at a second speed, said printhead being movable along said fixed angle vector at a third speed represented by the mathematical expression:

$$((\text{first speed})^2+(\text{second speed})^2)^{1/2}.$$

6. The method of operating an inkjet printer of claim 1, wherein said intermediate transfer member comprises one of a cylinder and a belt.

7. The method of operating an inkjet printer of claim 1, wherein said printhead moves across said intermediate transfer member in a direction generally perpendicular to said advance direction.

8. The method of operating an inkjet printer of claim 1, including the further step of resizing said bitmap image in a direction perpendicular to said advance direction.

9. The method of operating an inkjet printer of claim 8, wherein said resizing step includes changing a speed of movement of said carrier in said generally perpendicular direction.

10. The method of operating an inkjet printer of claim 1, including the further step of halftoning said bitmap image.

11. A method of operating an inkjet printer, comprising the steps of:

providing an intermediate transfer member movable in an advance direction;

providing a carrier supporting a printhead, said carrier being movable relative to said intermediate transfer member in a direction generally perpendicular to said advance direction, said printhead defining a plurality of raster lines extending over said intermediate transfer member at a non-perpendicular, fixed angle vector relative to said advance direction;

defining a bitmap image including an array of pixels, said bitmap image including image data corresponding to each pixel; and skewing said bitmap image such that said image data for a selected pixel location is shifted to a different pixel location, dependent upon said fixed angle vector.

12. The method of operating an inkjet printer of claim 11, wherein said skewing step includes shifting said image data at said selected pixel locations a predetermined number of pixel locations in a direction opposite to said advance direction.

13. The method of operating an inkjet printer of claim 11, wherein said skewing step includes shifting image data at said selected pixel locations an integer number of pixel locations in a direction opposite to said advance direction.

14. The method of operating an inkjet printer of claim 11, wherein said intermediate transfer member is movable in said advance direction at a first speed, and said carrier is movable in said perpendicular direction at a second speed, said printhead being movable along said fixed angle vector at a third speed represented by the mathematical expression:

$$((\text{first speed})^2+(\text{second speed})^2)^{1/2}.$$

15. The method of operating an inkjet printer of claim 11, wherein said intermediate transfer member comprises one of a cylinder and a belt.

16. The method of operating an inkjet printer of claim 11, including the further step of printing on the intermediate transfer member using said skewed bitmap image.

* * * * *